US007541730B2

(12) United States Patent
Song et al.

(10) Patent No.: US 7,541,730 B2
(45) Date of Patent: Jun. 2, 2009

(54) SEALING STRUCTURE OF FIELD EMISSION DISPLAY DEVICE AND METHOD OF MANUFACTURING THE SAME

(75) Inventors: Byong-Gwon Song, Seoul (KR); Moon-Jin Shin, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 183 days.

(21) Appl. No.: 11/354,870

(22) Filed: Feb. 16, 2006

(65) Prior Publication Data

US 2006/0186789 A1 Aug. 24, 2006

(30) Foreign Application Priority Data

Feb. 23, 2005 (KR) ..... 10-2005-0015053

(51) Int. Cl.
*H01J 1/62* (2006.01)
*H01J 61/24* (2006.01)
*H01J 19/70* (2006.01)

(52) U.S. Cl. ..... 313/495; 313/552; 313/553; 313/498

(58) Field of Classification Search ..... 313/495–498, 313/581–587
See application file for complete search history.

(56) References Cited

U.S. PATENT DOCUMENTS 5,525,861 A * 6/1996 Banno et al. ..... 313/495

(Continued)

FOREIGN PATENT DOCUMENTS

JP 2002-134019 5/2002

(Continued)

OTHER PUBLICATIONS

Yamada et al., Japanese Patent Publication, 2002-184328, Jun. 2002, machine translation.*

(Continued)

*Primary Examiner*—Sikha Roy
*Assistant Examiner*—Tracie Y Green
(74) *Attorney, Agent, or Firm*—Robert E. Bushnell, Esq.

(57) ABSTRACT

A sealing structure for a field emission display (FED) device and a method of manufacturing the same is provided. The sealing structure includes an upper substrate, a lower substrate, spacers, and a frit, wherein at least one exhaust outlet is formed in the frit. The method of manufacturing the sealing structure of the FED device prepares a lower substrate and an upper substrate, installs a frit having at least one exhaust outlet between the lower substrate and the upper substrate, and heats the lower substrate and the upper substrate while arranging the upper substrate on the lower substrate at a predetermined temperature to melt the frit in order to seal the space between the lower substrate and the upper substrate. Inner gas can be easily exhausted and the inside of the FED is reliably sealed while preventing damages of the spacers.

16 Claims, 8 Drawing Sheets

U.S. PATENT DOCUMENTS

| | | | | |
|---|---|---|---|---|
| 6,113,450 | A * | 9/2000 | Narayanan et al. | 445/25 |
| 6,963,165 | B2 * | 11/2005 | Park et al. | 313/495 |
| 2003/0013372 | A1 * | 1/2003 | Uemura et al. | 445/24 |
| 2003/0071562 | A1 * | 4/2003 | Ando | 313/496 |
| 2003/0071579 | A1 * | 4/2003 | Ryu et al. | 315/169.4 |
| 2003/0090196 | A1 * | 5/2003 | Ando | 313/495 |
| 2003/0137245 | A1 * | 7/2003 | Nakatani et al. | 313/582 |
| 2005/0085052 | A1 * | 4/2005 | Chen et al. | 438/471 |
| 2005/0179362 | A1 * | 8/2005 | Kijima et al. | 313/495 |
| 2006/0022594 | A1 * | 2/2006 | Kijima et al. | 313/553 |

FOREIGN PATENT DOCUMENTS

| | | |
|---|---|---|
| JP | 2002-184328 | 6/2002 |

OTHER PUBLICATIONS

Korean Office action for Korean Patent Application No. KR10-2005-0015053 dated Jun. 28, 2006.

* cited by examiner

SEALING STRUCTURE OF FIELD EMISSION DISPLAY DEVICE AND METHOD OF MANUFACTURING THE SAME

CLAIM OF PRIORITY

This application makes reference to, incorporates the same herein, and claims all benefits accruing under 35 U.S.C. § 119 from an application for SEALING STRUCTURE OF A FILED EMISSION DISPLAY DEVICE, AND A MANUFACTURING METHOD OF THE SAME, earlier filed in the Korean Intellectual Property Office on the 23$^{rd}$ of February, 2005 and there duly assigned Serial No. 10-2005-0015053.

BACKGROUND OF THE INVENTION

1. Field of the Invention

The present invention relates to a field emission display (i.e., "FED") device, and more particularly, to a sealing structure of a FED device and a method of manufacturing the same.

2. Description of the Related Art

In general, a field emission display (i.e., a "FED") device is one of flat panel display devices, and formed of a tip-shaped or wedge-shaped cathode and an anode on which a fluorescent substance is coated. When electrons emitted from a predetermined portion of the cathode collide with the fluorescent substance, the fluorescent substance illuminates to visually display desired patterns, characters, or signs. The FED device can display high resolution and high luminance color patterns while consuming minimum electrical power.

Such a FED device forms a micro-tip shaped cathode in order to focus an electric field, forms a gate for inducing the electric field, and forms an anode on which a fluorescent substance is coated. Electrons are emitted from a plurality of micro-tips, and the electrons collide with the fluorescent substance of the anode having a transparent conductive film; thus the fluorescent substance is stimulated and the outermost electrons of the fluorescent substance are excited and transited. Then, the light generated by the excitement and transition is used to visually display desired images. Studies about such a FED device have been performed for a long time.

A substrate assembly for a FED device is manufactured during a packaging process, in which an upper substrate and a lower substrate having an anode and a cathode, respectively, are aligned and heated in a firing furnace at a temperature of 400° C.

In such a packaging process described above, however, carbon nano-tubes are easily oxidized in high temperature process due to the oxygen remaining in the firing furnace. In fact, during the packaging process, a large number of the carbon nano-tubes are oxidized, and the emission characteristic of carbon nano-tubes seriously deteriorates. In order to solve such problems, oxygen is completely removed from the firing furnace, and the baking process is performed after injecting an inert gas, such as nitrogen, into the firing furnace.

SUMMARY OF THE INVENTION

The present invention provides a sealing structure of a field emission display (FED) device for preventing the deterioration of an emission characteristic of carbon nanotubes, and reducing a process time and a number of steps in a high temperature process by improving the shape and manufacturing method of a frit which seals the FED device, and a method of manufacturing the same.

According to an aspect of the present invention, there is provided a sealing structure of an FED device, constructed with an upper substrate, a lower substrate separated from the upper substrate by a predetermined distance, spacers for maintaining the distance between the upper substrate and the lower substrate, and a frit for sealing the space between the upper substrate and the lower substrate, wherein at least one exhaust outlet is formed in the frit.

The exhaust outlet may be formed as a groove in the frit. The exhaust outlet may be formed as a hole in the frit. The frit may have connections for connecting the frit to other frits. The connections may be formed at both ends of the frit.

The frit may further include getter combining grooves for installing getters that absorb inner gas produced in the space between the upper substrate and the lower substrate.

The frit may be manufactured by forming at least two separate members and combining the separate members. The separate members may be formed by any one of molding and injection molding.

The frit may have at least two sub-frits connected to each other. The sub-frits may be connected to each other at a predetermined angle. The sub-frits may be identical.

A vacuum exhaust pipe may be formed in any one of the lower substrate and the upper substrate.

According to another aspect of the present invention, there is provided a method of manufacturing a sealing structure of an FED device, by preparing a lower substrate and an upper substrate, installing a frit which has at least one exhaust outlet, between the lower substrate and the upper substrate, and heating the lower substrate and the upper substrate while arranging the upper substrate on the lower substrate at a predetermined temperature to melt the frit in order to seal the space between the lower substrate and the upper substrate.

The method may install spacers separated from the frit by a predetermined distance before the heating of the lower substrate and the upper substrate.

According to still another aspect of the present invention, there is provided a method of manufacturing a sealing structure of an FED device by arranging a lower substrate and an upper substrate, forming spacers between the lower substrate and the upper substrate, forming a frit, which is longer than the spacer by a predetermined length, separated from the spacer by a predetermined distance, and heating the lower substrate and the upper substrate while arranging the upper substrate on the lower substrate to reduce the height of the frit in order for the spacers to contact the lower substrate and the upper substrate.

The frit may include at least one exhaust hole. According to the sealing structure of the FED device, the inner gas can be easily exhausted because the frit includes exhaust grooves or exhaust holes.

In addition, the sealing structure of the FED device manufactured according to the principles of the present invention can reliably seal the inside of the FED device while preventing the damage of the spacers.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
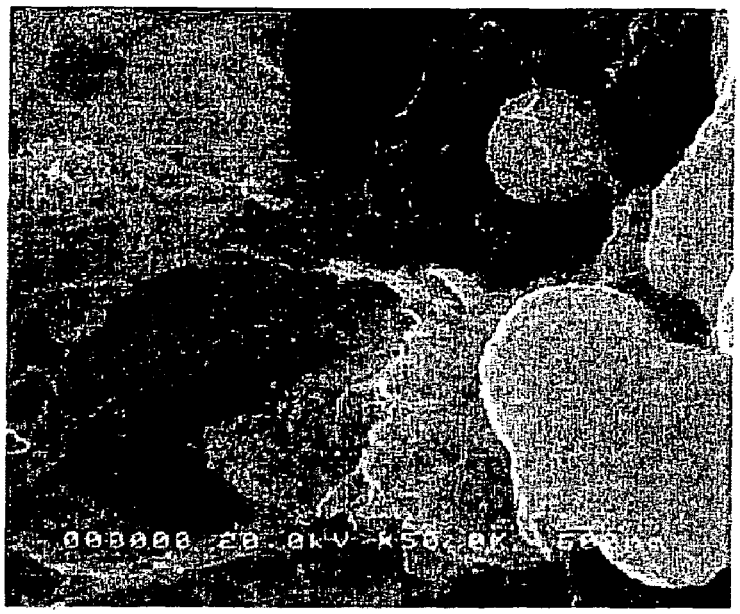
FIG. 1 shows a photo of carbon nano-tubes before firing in a packaging process.
Figure 2:
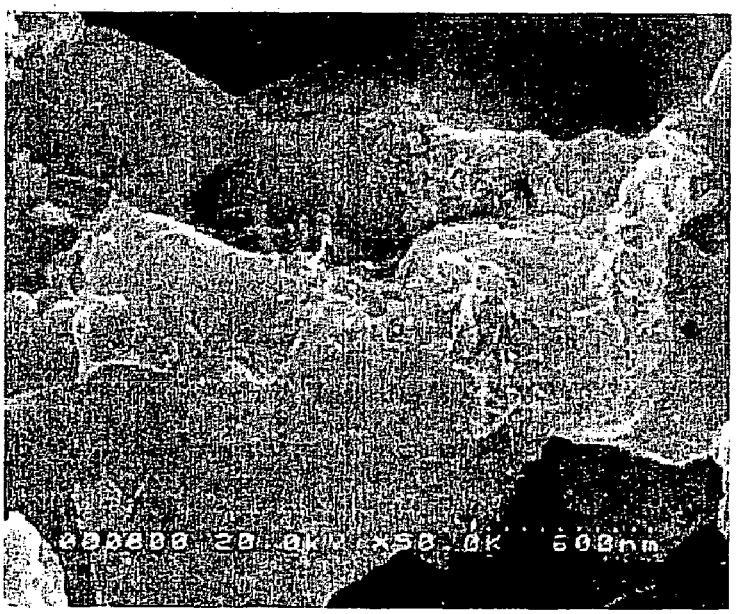
FIG. 2 shows a photo of carbon nano-tubes of FIG. 1 after firing in the packaging process.

As described above, carbon nano-tubes are easily oxidized during firing in the packaging process. Such a problem can be observed in a texture of carbon nano-tubes as shown in FIGS. 1 and 2. FIG. 1 shows a photo of carbon nano-tubes before firing in the packaging process, and FIG. 2 shows a photo of carbon nano-tubes of FIG. 1 after firing in the packaging process. Referring to FIGS. 1 and 2, the number of carbon nano-tubes is significantly reduced after the firing in the packaging process. In the experiment counting carbon nano-tubes shown in FIGS. 1 and 2, it is found that the number of carbon nano-tubes is reduced by 87% after firing in the packaging process.

The sealing structures of field emission display devices and methods of manufacturing the same according to embodiments of the present invention will now be described in detail with reference to the accompanying drawings. The same reference numerals refer to the same or comparable components.

Figure 3:
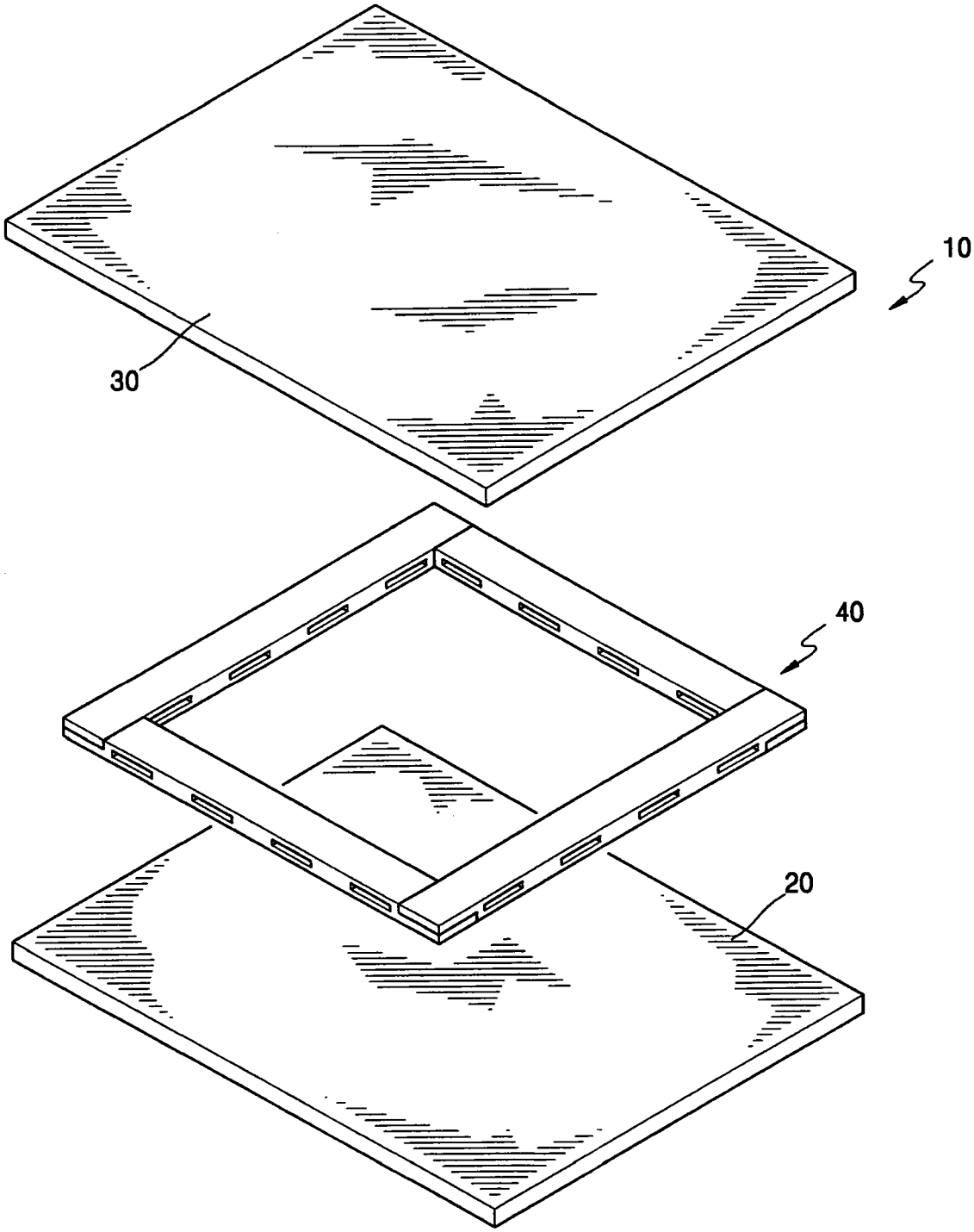
FIG. 3 is a perspective view of a sealing structure of a field emission display (FED) device.

FIG. 3 is a perspective view illustrating a sealing structure of a field emission display (FED) device according to the present invention.

Referring to FIG. 3, the sealing structure 10 of the FED device includes a lower substrate 20, an upper substrate 30, and a frit 40 arranged between the lower substrate 20 and the upper substrate 30.

Each of the lower substrate 20 and the upper substrate 30 has an anode and a cathode. In addition, a plurality of carbon nano-tubes for emitting electrons are formed on the lower substrate 20.

On the other hand, a vacuum exhaust pipe (not shown) penetrates the upper substrate 30 or the lower substrate 20. In the sealing structure 10 of the FED device according to the present invention, the number of vacuum exhaust pipes can be reduced, since separate exhaust outlets for exhausting inner gas are formed on the frit 40.

Figure 4:
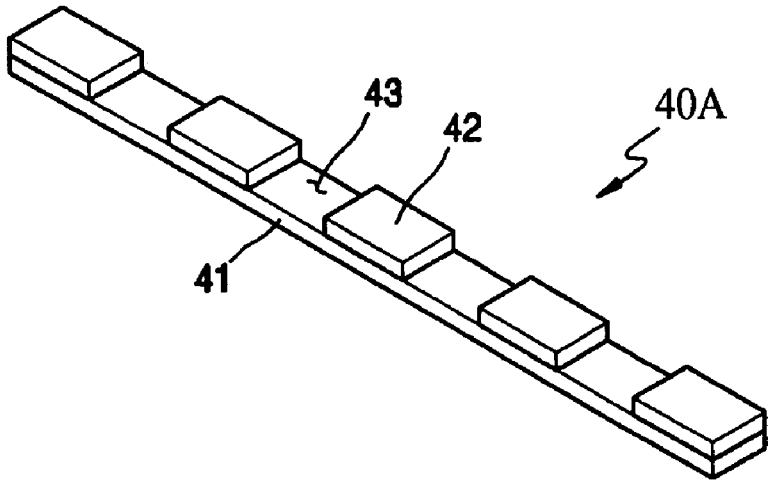
FIG. 4 is a perspective view of a frit for a sealing structure of a FED device constructed as a first embodiment of the present invention.

FIG. 4 is a perspective view of a frit for a sealing structure of a FED device according to a first embodiment of the present invention. Referring to FIG. 4, the frit 40A includes a base 41, convex units 42 formed on the base 41 with predetermined intervals, and concave units 43 formed between the convex units 42. In this case, the concave units 43 operate as exhaust grooves to exhaust inner gas from the FED device. Multiple concave units 43 may be formed with predetermined intervals in order to increase an amount of exhaust through the frit 40A.

When an inert gas such as nitrogen is injected into the FED device in a firing furnace as a substitute for the inner gas in the FED device, the exhausting speed and the amount of inner gas exhausted from the FED device are improved, because the frit 40A includes the convex units 42 and the concave units 43. Therefore, the inner gas in the FED device can be easily exhausted from the FED device.

Figure 5:
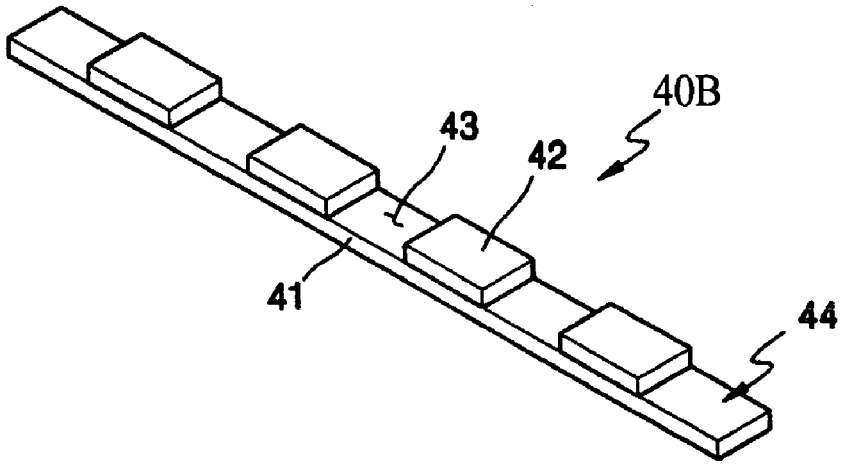
FIG. 5 is a perspective view of a frit for a sealing structure of a FED device constructed as a second embodiment of the present invention.

FIG. 5 is a perspective view of a frit for a sealing structure of a FED device according to a second embodiment of the present invention. Referring to FIG. 5, the frit 40B includes a base 41, convex units 42 and concave units 43 formed on the base 41, and connection units 44 formed at both ends of the base 41. Since the frit 40B includes the connection units 44, the frit 40B can be easily connected with another frit 40B.

Figure 6:
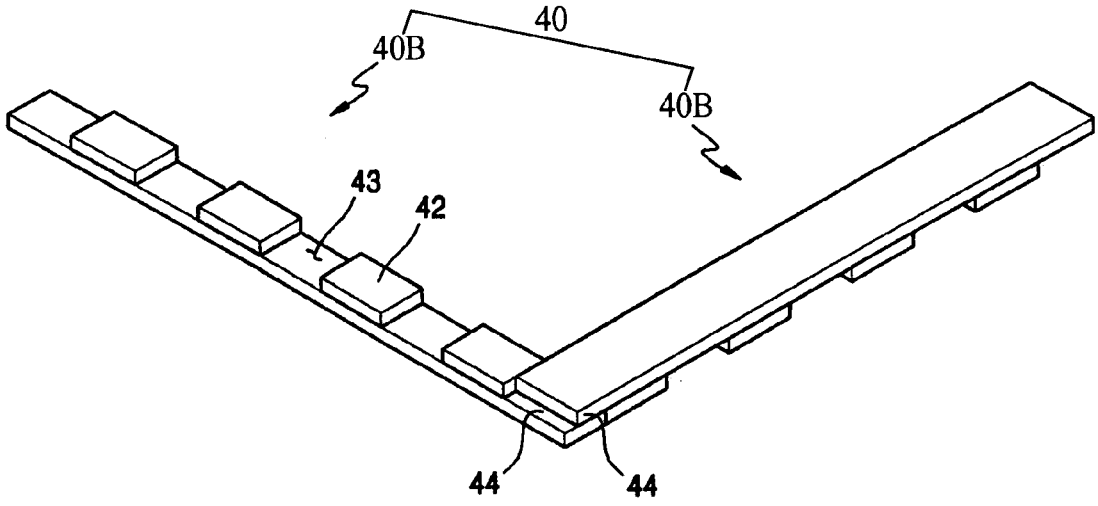
FIG. 6 is a perspective view illustrating an example of combined frits of FIG. 5.

FIG. 6 is a perspective view illustrating an example of a combination of the frits 40B from FIG. 5 to complete a frit 40. Referring to FIG. 6, the frits 40B are combined by having a connection unit 44 of a frit 40B engage with connection unit 44 of another frit 40B. In this case, the frits 40B can be combined while forming a predetermined angle therebetween, for example, a right angle.

The angle between the frits 40B can be easily controlled. Accordingly, the combination angle of the frits 40B can be controlled based on the sealing structure of the FED device. Therefore, a frit 40 having a required structure can be manufactured by combining sub-frits 40B.

Figure 7:
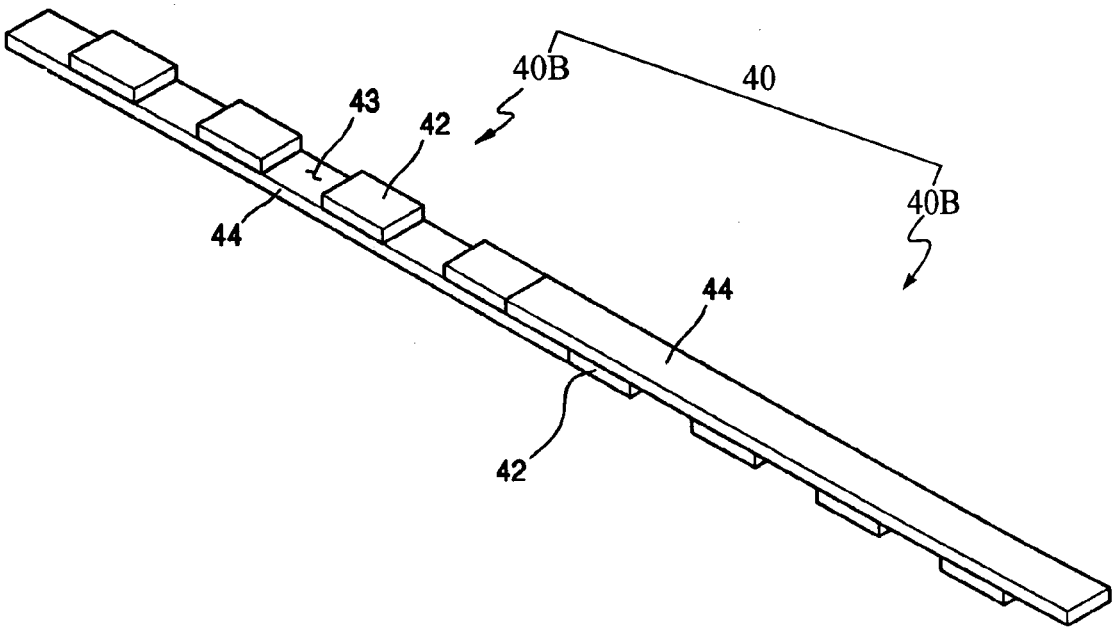
FIG. 7 is a perspective view illustrating another example of combined frits of FIG. 5.

FIG. 7 is a perspective view of another example of a combination of the frits 40B of FIG. 5 to complete a frit 40. Referring to FIG. 7, frits 40B can be connected into a shape of a straight line by having a frit 40B engage with another frit 40B through the connection units 44 of the frits 40B. Accordingly, a length of a frit 40 increases by connecting multiple frits 40B through the connection units 44. Since the length of the frit 40 can be controlled this way, a frit 40 with the predetermined length required by the sealing structure of the FED device can be easily realized.

Regarding FIGS. 6 and 7, the frit 40 can be made with various types of frits 40B or with identical type of frits 40B to provide more flexibility in manufacturing of a sealing structure of a FED device. For example, frits 40B with different lengths could be combined to make a frit 40 with a predetermined length required by the sealing structure of the FED device. Each frit 40B included in the frit 40 may be produced by a method of molding or injection molding to have a predetermined shape.

Figure 8:
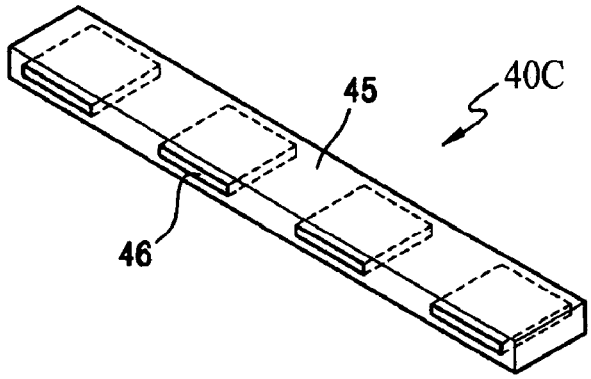
FIG. 8 is a perspective view of a frit for a sealing structure of a FED device constructed as a third embodiment of the present invention.

FIG. 8 is a perspective view of a frit for a sealing structure of an FED device according to a third embodiment of the present invention. Referring to FIG. 8, the frit 40C includes a body unit 45 and exhaust holes 46 formed in the body unit 45.

A plurality of exhaust holes 46 may be formed while having predetermined intervals in order to increase an amount of exhaust through the frit 40C.

Since the exhaust holes 46 are formed in the body unit 45 of the frit 40C, the frit 40C can exhaust inner gas of the FED device, even without directly contacting another member, for example, an upper substrate 30 or a lower substrate 20. Accordingly, the arrangement of the frit 40C is not limited, and can be optimally selected to realize a required sealing structure of the FED device.

Figure 9:
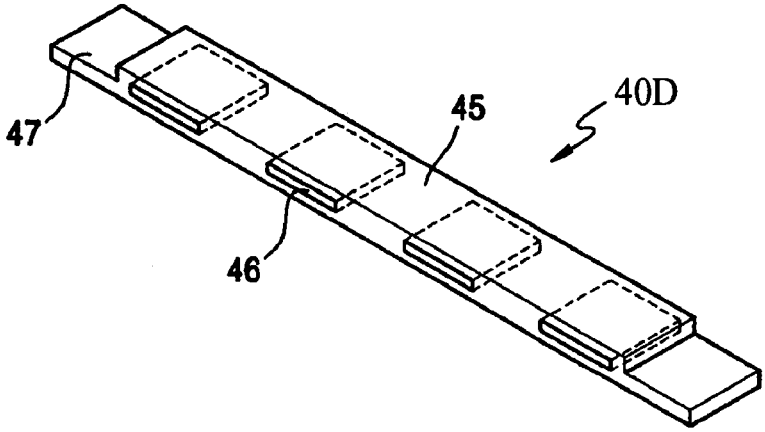
FIG. 9 is a perspective view of a frit for a sealing structure of a FED device constructed as a fourth embodiment of the present invention.

FIG. 9 is a perspective view of a frit for a sealing structure of an FED device according to a fourth embodiment of the present invention. Referring to FIG. 9, the frit 40D includes a body unit 45, exhaust holes 46 formed in the body unit 45, and connection units 47 formed at both ends of the body unit 45. The exhaust holes 46 operate as passages for exhausting the inner gas of the FED device. A plurality of exhaust holes 46 may be formed at predetermined intervals to increase an amount of the exhausted gas. In this case, the arrangement of the frits 40D can be freely selected to realize a required sealing structure of the FED device, and a length of a complete frit can be easily controlled by connecting multiple frits 40D through the connection units 47.

Figure 10:
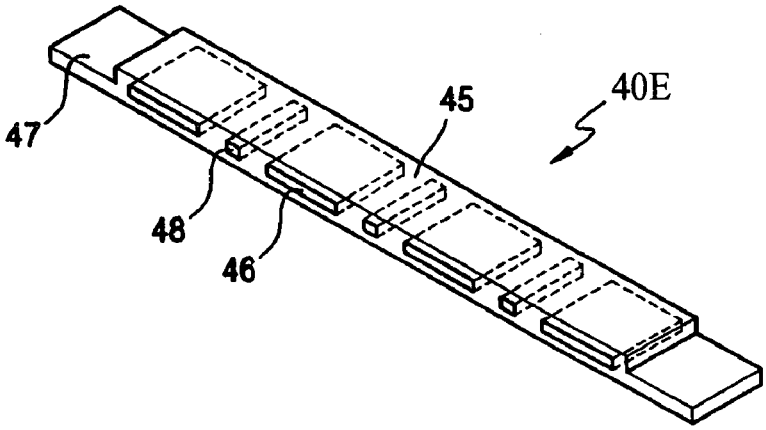
FIG. 10 is a perspective view of a frit for a sealing structure of a FED device constructed as a fifth embodiment of the present invention.

FIG. 10 is a perspective view of a frit for a sealing structure of a FED device according to a fifth embodiment of the present invention. Referring to FIG. 10, the frit 40E includes a body unit 45, exhaust holes 46 formed in the body unit 45, connection units 47 formed at both ends of the body unit 45, and getter combination grooves 48.

In this case, getters are installed in the getter combination grooves 48 to absorb the inner gas of the FED device during the manufacture of the sealing structure. Since the inner gas of the FED device is absorbed through the getters that are installed in the getter combining grooves 48, the inner gas can be easily exhausted.

Figure 11:
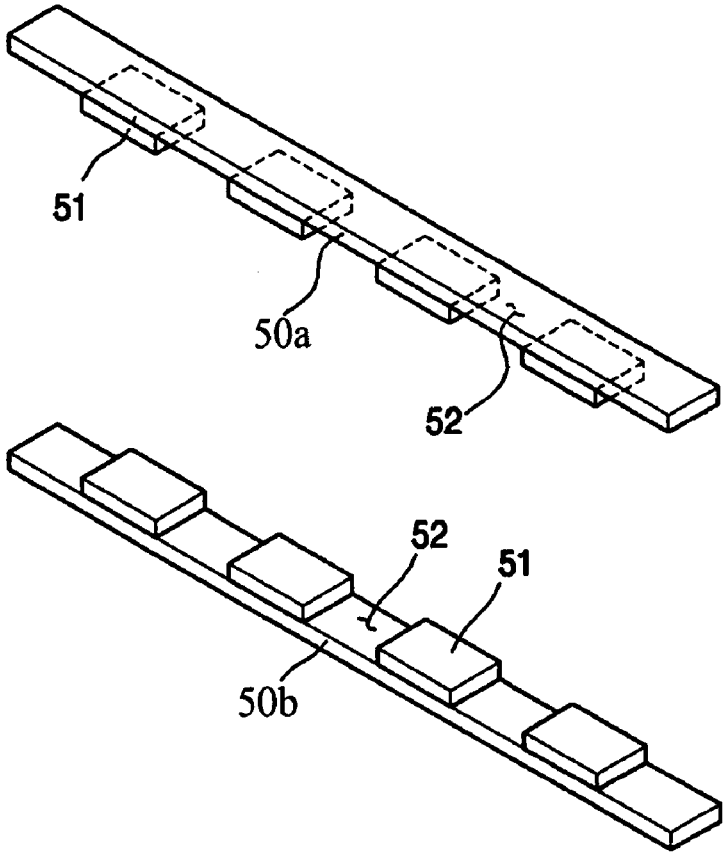
FIG. 11 is a perspective view illustrating members of the frit shown in FIG. 8 before assembly.
Figure 12:
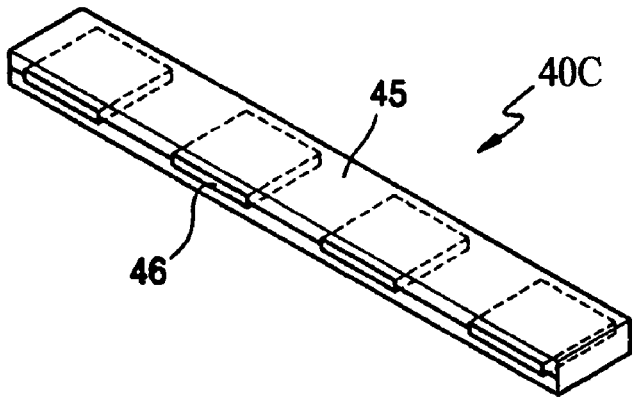
FIG. 12 is a perspective view illustrating members of the frit shown in FIG. 8 after assembly.

FIG. 11 is a perspective view illustrating members of the frit 40C shown in FIG. 8 before assembly, and FIG. 12 is a perspective view illustrating members of the frit 40C shown in FIG. 8 after the assembly. Referring to FIGS. 11 and 12, the frit 40C can be manufactured by combining an upper member 50*a* and a lower member 50*b*, both of which have convex units 51 and concave units 52. The convex units 51 and the concave units 52 of the upper member 50*a* and the lower member 50*b* are first manufactured, and then the upper member 50*a* and the lower member 50*b* are assembled. Therefore, the exhaust holes 46 can be easily formed.

Figure 13:
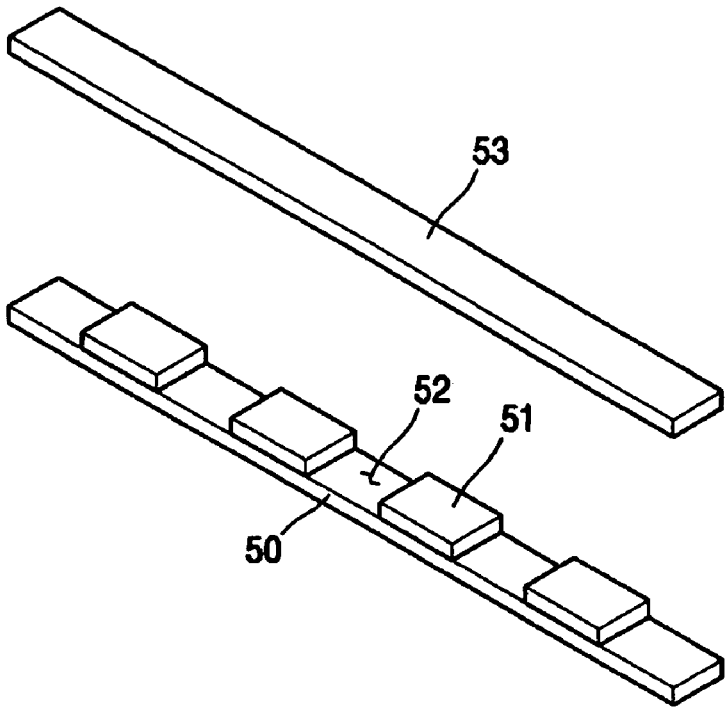
FIG. 13 is a perspective view illustrating members of the frit shown in FIG. 9 before assembly.
Figure 14:
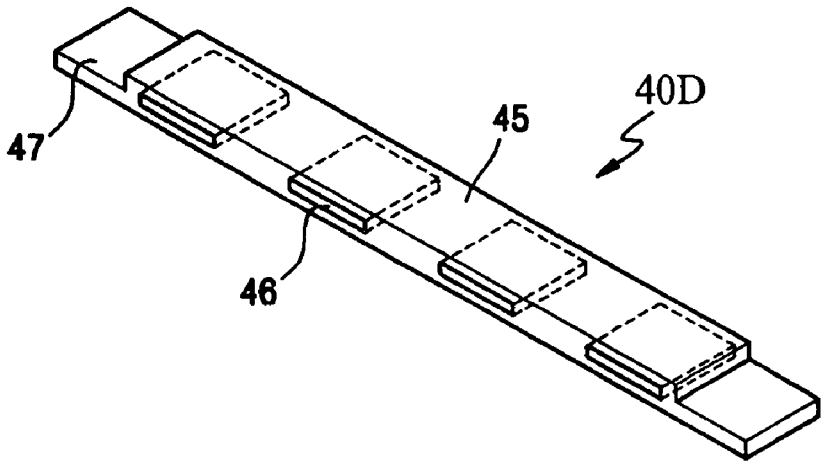
FIG. 14 is a perspective view illustrating members of the frit shown in FIG. 9 after assembly.

FIG. 13 is a perspective view illustrating members of the frit 40D shown in FIG. 9 before assembly, and FIG. 14 is a perspective view illustrating members of the frit 40D shown in FIG. 9 after the assembly. Referring to FIGS. 13 and 14, the frit 40D can be manufactured by combining a lower member 50 having convex units 51 and concave units 52 and an upper member 53 having a flat surface that is being attached to the lower member 50. Since the convex units 51 and the concave units 52 are formed on the lower member 50 only, the process for forming the exhaust holes 46 is simplified, and the frit 40D can be more easily manufactured.

Figure 15A:
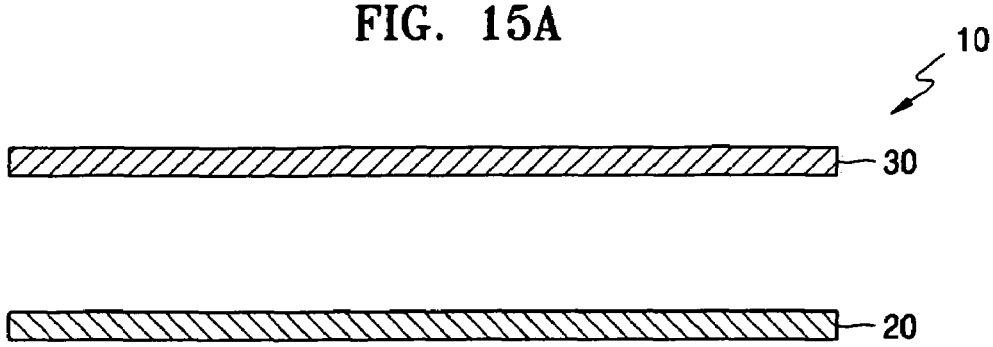
FIGS. 15A through 15D are cross-sectional views illustrating a method of manufacturing a sealing structure of an FED device performed according to the principles of the present invention.

FIGS. 15A through 15D are cross-sectional views illustrating a method of manufacturing a sealing structure of a FED device according to the present invention. Referring to FIG. 15A, a lower substrate 20 and an upper substrate 30, which is separated from the lower substrate 20 by a predetermined distance, are prepared.

Figure 15B:
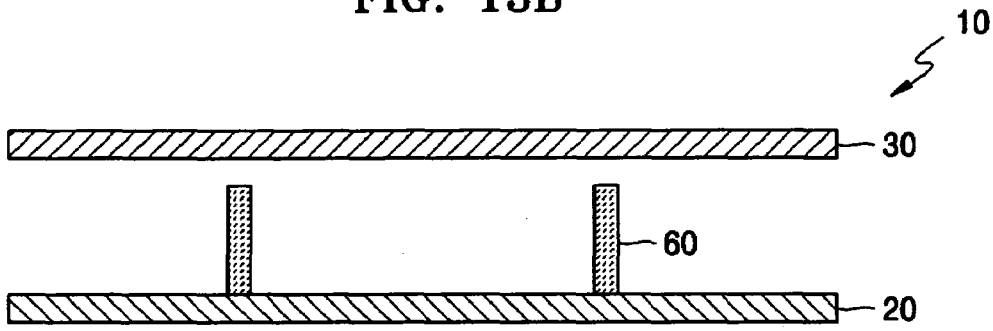

Referring to FIG. 15B, spacers 60 having a predetermined height are installed on the lower substrate 20.

Figure 15C:
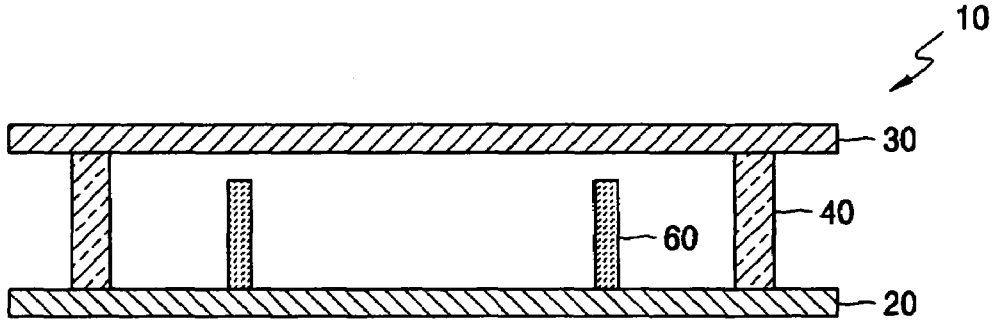

Referring to FIG. 15C, frits 40 are installed between the upper substrate 30 and the lower substrate 20. In this case, frits 40 are installed at the outside of the spacers 60 while maintaining a predetermined distance from the spacers 60. The height of frits 40 is larger than the height of the spacers 60.

Figure 15D:
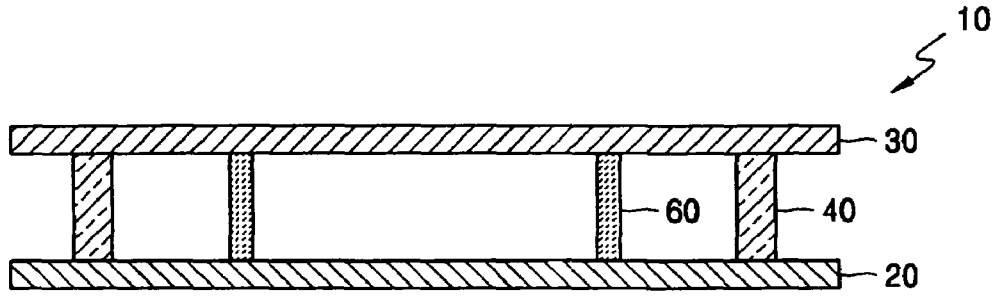

Referring to FIG. 15D, the lower substrate 20 and the upper substrate 30 are heated in a firing furnace at a predetermined temperature, while the spacers 60 and the frits 40 are arranged between the lower substrate 20 and the upper substrate 30. As the frits 40 melt, the height of the frits 40 decreases, and thus the heights of the frits 40 and the spacers 60 become almost equal. In addition, the frits 40 adhere to both of the upper substrate 30 and the lower substrate 20 to seal the space between the upper substrate 30 and the lower substrate 20.

When the sealing structure of the FED device is formed according to the present invention, the space between the upper substrate 30 and the lower substrate 20 can be reliably sealed while preventing the damage of the spacers 60.

According to the sealing structure of the FED device according to the present invention, the exhaust grooves or the exhaust holes are formed in the frit that forms the sealing structure, and thus the inner gas can be easily exhausted.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A sealing structure of a field emission display device, comprising:

an upper substrate;

a lower substrate separated from the upper substrate by a predetermined distance;

spacers for maintaining the distance between the upper substrate and the lower substrate; and a frit formed between the upper substrate and the lower substrate for sealing the space between the upper substrate and the lower substrate, the frit having at least one exhaust outlet that drains inner gas inside the sealing structure out of the sealing structure, the frit further comprising at least two sub-frits connected to each other, each of the sub-frits having connection units formed at both ends of the each of the sub-frits, each of the sub-frits having at least one exhaust outlet.

2. The sealing structure of claim 1, wherein the exhaust outlet is formed in a groove shape in the frit.

3. The sealing structure of claim 1, wherein the exhaust outlet is formed in a hole shape in the frit.

4. The sealing structure of claim 1, wherein the frit has connection units for being connected to another frit.

5. The sealing structure of claim 4, wherein the connection units are formed at both ends of the frit.

6. The sealing structure of claim 1, wherein the frit further includes getter combination grooves for installing getters absorbing inner gas in a space between the upper substrate and the lower substrate.

7. The sealing structure of claim 1, wherein the sub-frit is formed by any one of molding and injection molding.

8. The sealing structure of claim 1, wherein a vacuum exhaust pipe is formed in any one of the lower substrate and the upper substrate.

9. A sealing structure of a field emission display device, comprising:

an upper substrate;

a lower substrate separated from the upper substrate by a predetermined distance;

spacers for maintaining the distance between the upper substrate and the lower substrate; and a frit formed between the upper substrate and the lower substrate for sealing the space between the upper substrate and the lower substrate, the frit comprising at least two sub-frits, one of the sub-frits having a base and a plurality of convex units formed on the base, a space between two of the convex units of the one of the sub-frits forming an exhaust outlet to exhaust inner gas inside the sealing structure out of the sealing structure, the convex units of the one of the sub-frits contacting the upper substrate.

10. The sealing structure of claim 9, wherein the one of the sub-frits has a connection unit at an end of the base for being connected to another of the sub-frits.

11. The sealing structure of claim 9, wherein another of the sub-frits has a base and a plurality of convex units formed on the base, a space between two of the convex units of the another of the sub-frits forming an exhaust outlet, the convex units of the another of the sub-frits contacting the lower substrate.

12. The sealing structure of claim 11, wherein the base of the one of the sub-frits has a connection unit at an end of the base of the one of the sub-frits, the base of the another of the sub-frits having a connection unit at an end of the base of the another of the sub-frits, the one of the sub-frits and the another of the sub-frits being connected through the connection unit of the one of the sub-frits and the connection unit of the another of the sub-frits.

13. The sealing structure of claim 12, wherein the one of the sub-frits and the another of the sub-frits are connected forming a substantially straight line.

14. The sealing structure of claim 12, wherein the one of the sub-frits and the another of the sub-frits are connected forming a substantially L-shape.

15. A sealing structure of a field emission display device, comprising:

an upper substrate;

a lower substrate separated from the upper substrate by a predetermined distance;

spacers for maintaining the distance between the upper substrate and the lower substrate; and a frit formed between the upper substrate and the lower substrate for sealing the space between the upper substrate and the lower substrate, the frit comprising:

a base;

a plurality of convex units formed on the base, a space between two of the convex units of the one of the sub-frits forming an exhaust outlet to exhaust inner gas inside the sealing structure out of the sealing structure, one of the convex units having a getter combination groove for installing a getter absorbing inner gas; and an upper member formed on the top of the convex units.

16. The sealing structure of claim 15, wherein each of the convex units has a getter combination groove.

* * * * *